US005163608A

United States Patent [19]

Block

[11] Patent Number: 5,163,608

[45] Date of Patent: Nov. 17, 1992

[54] COMBINATION POSTCARD/CONTAINER INSULATOR

[75] Inventor: Jonathan D. Block, Atlanta, Ga.

[73] Assignee: Premium Vision, Inc., Atlanta, Ga.

[21] Appl. No.: 585,254

[22] Filed: Sep. 19, 1990

[51] Int. Cl.[5] ..... B42D 15/02; B65D 65/00

[52] U.S. Cl. ..... 229/92.8; 220/903; 383/4

[58] Field of Search ..... 229/90, 91, 92.8; 220/903; 215/11.6, 12.1; 383/110, 4

[56] References Cited

U.S. PATENT DOCUMENTS

| | | | |
|---|---|---|---|
| 2,579,701 | 12/1951 | Ridey et al. | 215/11.6 X |
| 2,745,569 | 5/1956 | Seaman | 215/12.1 X |
| 4,268,567 | 5/1981 | Harmony | 220/903 X |
| 4,282,279 | 8/1981 | Strickland | 220/903 X |
| 4,344,303 | 8/1982 | Kelly, Jr. | 215/12.1 X |
| 4,399,668 | 8/1983 | Williamson | 215/12.1 X |
| 4,478,265 | 10/1984 | DeMarco | 220/903 X |
| 4,526,280 | 7/1985 | Taylor | 215/12.1 X |

FOREIGN PATENT DOCUMENTS

| | | | |
|---|---|---|---|
| 1023525 | 3/1953 | France | 229/91 |

*Primary Examiner*—Stephen P. Garbe
*Assistant Examiner*—Jes Pascua
*Attorney, Agent, or Firm*—B. J. Powell

[57] ABSTRACT

A combination postcard/container insulator with a substantially rectilinear sheet of flexible insulating material to wrap around the container and fasteners to maintain the sheet wrapped around the container yet are mailable.

8 Claims, 3 Drawing Sheets

COMBINATION POSTCARD/CONTAINER INSULATOR

BACKGROUND OF THE INVENTION

This invention relates generally to container insulators and more particularly to a container insulator which can be unfolded so that it can be mailed as a postcard.

Container insulators are currently available which hold containers to reduce the heat transfer out of the container. Typically, these insulators are performed and the container is pushed down into the cavity in the insulator. Such insulators are difficult to store and handle when they are not being used to insulate containers. Thus, there is a need for a container insulator which can be stored flat but which may be erected around the container to insulate the container as is being used.

SUMMARY OF THE INVENTION

These and other problems and disadvantages associated with the prior art are overcome by the invention disclosed herein by providing a combination postcard-/container insulator which can be wrapped around a beverage container to reduce the heat loss from the container and alternatively may be unfolded into a flat condition. Additionally, the combination postcard/insulator of the invention meets the governmental regulations for mailing so that the invention can be mailed through the regular mail service. Further, space is provided for addressing the insulator and for writing messages thereon as well as printing scenes thereon.

The combination postcard/container insulator of the invention includes a substantial rectilinear sheet of flexible material which has fastening means on opposite ends to fasten the sheet of material around the container so as to insulate the container. The sheet of material has a relaxed flat condition and the fastening means is constructed and arranged to be acceptable for mailing when the sheet is in its relaxed flattened condition. Surface areas are provided which can be written upon to record messages and postal stamps applied for mailing of the flattened sheet. The fastening means may be a series of snap fasteners which snap together to mount the sheet around the container or alternatively may be a slot/tab arrangement which hooks together to maintain the sheet of material in place around the container.

These and other features and advantages of the invention will become more clearly understood upon consideration of the following detailed description and accompanying drawings wherein like characters of reference designate corresponding parts throughout the several views and in which:

These figures and the following detailed description disclose specific embodiments of the invention, however, it is to be understood that the inventive concept is not limited thereto since it may be embodied in other forms.

DETAILED DESCRIPTION OF ILLUSTRATIVE EMBODIMENTS

Figure 1:
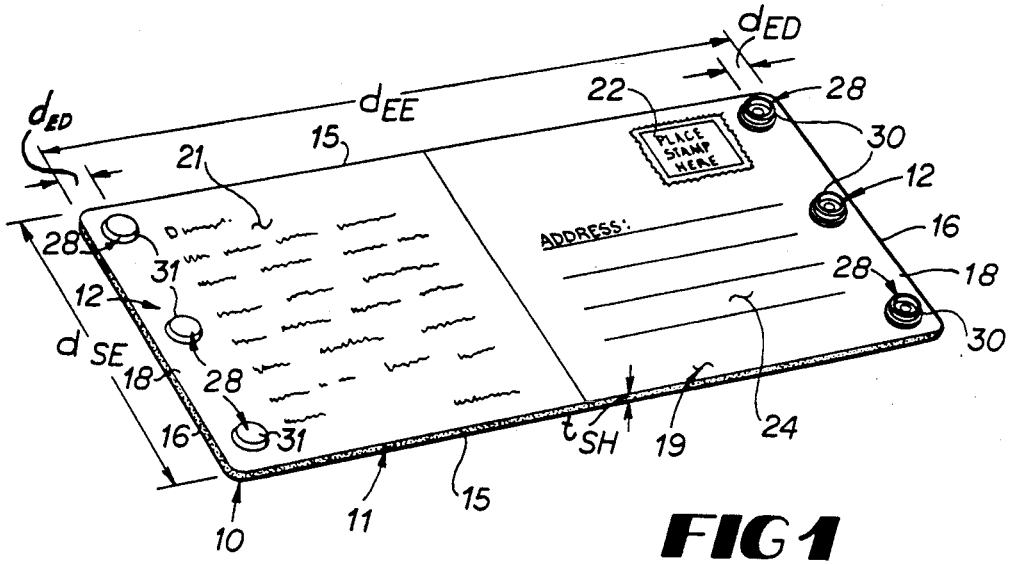
FIG. 1 is a perspective view of the invention showing one side thereof.
Figure 2:
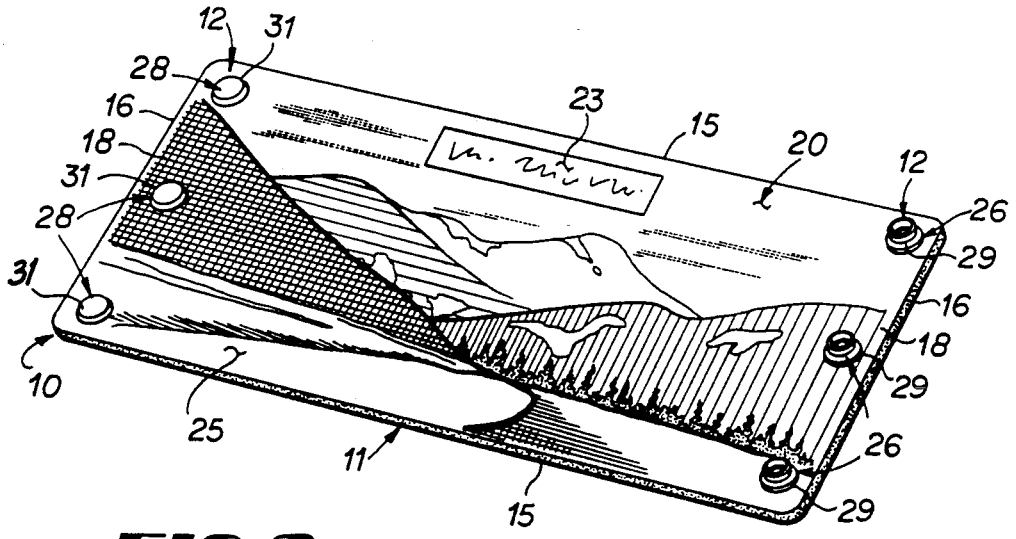
FIG. 2 is a perspective view of the invention showing the other side thereof.
Figure 3:
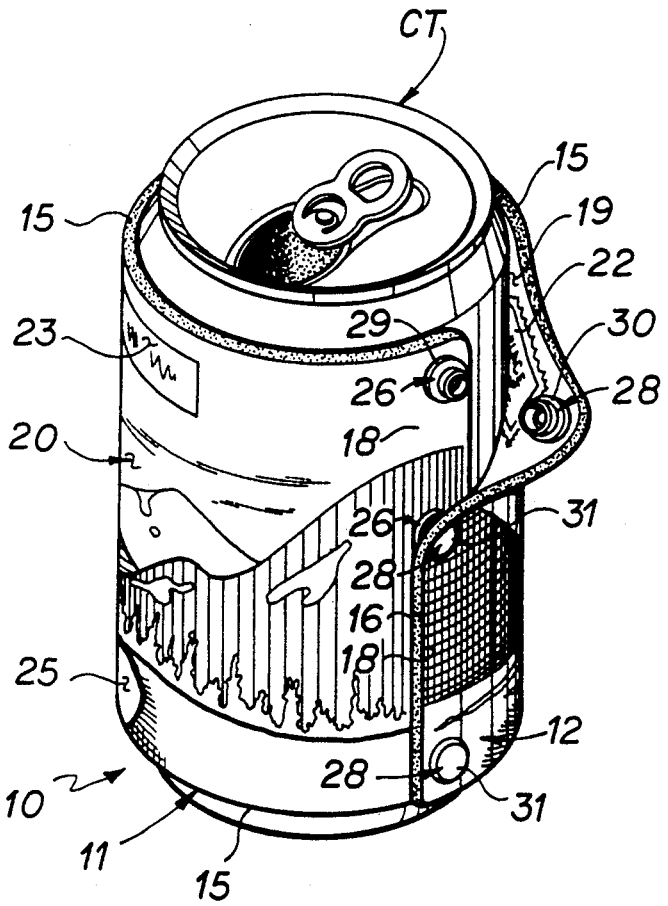
FIG. 3 is a perspective view showing the invention installed on a container.

Referring to the FIGS. 1–3, it will be seen that the combination postcard/container insulator 10 is designed for use both as a postcard and for wrapping around a container CT such is that commonly used by the beverage industry. These containers CT have a prescribed standard sidewall height and a prescribed standard peripheral length around the sidewall. The container CT illustrated has reduced diameter sections at the upper and lower ends of the container and is provided with an opening to allow the beverage in the container to be consumed.

The combination postcard/container insulator 10 includes a substantially rectilinear sheet of flexible material 11 equipped with fastening means 12 so that the sheet 11 may be wrapped around the container CT and held in position as illustrated in FIG. 3. The sheet 11 may be made of any convenient material with sufficient flexibility to be wrapped around the container CT. Such materials may include a fiberboard and various foamed plastic materials. As will become more apparent, foamed ethyl vinyl acetate is preferred although other acetates may be used.

The size thickness of the sheet 11 is selected to be within the governmental postal regulations so that the combination postcard/container insulator 10 may be mailed. Further, the sheet 11 defines a pair of spaced apart parallel sides edges 15 which are spaced apart the distance $d_{SE}$ seen in FIG. 1 that corresponds to the sidewall height of the container CT as best seen in FIG. 3. The sheet 11 also defines a pair of spaced apart end edges 16 which are generally parallel to each other and joined with opposite ends of the side edges 15 as seen in FIGS. 1–3. The end edges 16 are spaced apart a distance $D_{EE}$ also seen in FIG. 1 which is greater than the peripheral length of the container sidewall so that opposite ends 18 of the sheet 11 will overlap when the sheet is wrapped around the container CT as seen in FIG. 3. The amount of overlap is selected so that the fastening means 12 can be fastened to maintain the sheet 11 in position around the container CT as will become more apparent. The thickness $t_{SH}$ seen in FIG. 1 of the sheet 11 is selected so that the combination postcard/container insulator 10 may be sent through the mail. While different thicknesses $t_{SH}$ may be selected, a thickness of about 1/16–⅛ inch has proved to be satisfactory.

Additionally, the material for sheet 11 is selected so that the sheet 11 is flat when it is released and moves toward the flattened condition as illustrated in FIGS. 1 and 2 when any forces holding the sheet 11 in a deformed position are released. Thus, the material selected for the sheet 11 should preferably have some memory to straighten itself back to its flattened condition for ease in mailing.

The sheet 11 has a first side 19 and a second opposite side 20 with the first side 19 being seen in FIG. 1 and the second side 20 being seen in FIG. 2. The first side 19 is divided up into a first writing surface area 21 which can be written upon with pencil or pen to record any message. A second stamp mounting surface area 22 is provided on the first side 19 and is adapted to support a postage stamp thereon for mailing. A third address writing surface area 24 is also provided on the side 19 for use in addressing the combination postcard/container insulator 10 for mailing.

While the opposite side 20 may be used as an additional message writing surface, it is preferably used as a printed surface area 25 on which scenes and the like can be pre-printed so that the combination postcard/container insulator 10 may be used as a souvenir postcard. A second printed surface area 33 may also be provided on the second side 20 for the printing of advertising or facility logos.

The fastening means 12 may be any convenient fastening arrangement which meets mailing requirements when applied to the sheet 11. The fastening means 12 illustrated in FIGS. 1-3 comprises a snap fastener system including a plurality of male snap fastener components 26 and a plurality of complementary female snap fastener components 28 that snap together to attach the overlapping ends 18 of sheet 11 together. While the components 26 and 28 attached to the opposite ends 18 may be mixed as long as complementary components 26 and 28 are in registration with each other when the ends 18 overlap, they are illustrated with the female components 28 attached to one of the ends 18 while the male components 26 are attached to the opposite end 18 of the sheet 11. The operating end 29 of the male snap component 26 faces one side of the sheet 11 while the operating end 30 of the female component 28 faces the opposite side of the sheet 11 so that, when the ends of the sheet 11 overlap, the male and female operating ends 29 and 30 are in registration with each other to be snapped together.

It will also be appreciated that each of the male and female components 26 and 28 have an attachment cover 31 used to attach the operating end of the particular component 26 or 28 to the sheet 11 with the cover 31 being located on the opposite side of the sheet 11 from the operating end of that component. It will be appreciated that the sheet 11 must be wrapped around the container CT so that the operating end on the fastener component on the underlying end 18 of the sheet 11 faces outwardly while the operating end on the fastener component on the overlying end 18 on the sheet 11 faces inwardly so that the operating ends of the fastener components 26 and 28 are in registration with each other and can be snapped together. The fastener components 26 and 28 are commercially available.

The snap fastener components 26 and 28 are located a prescribed edge distance $d_{ED}$ from the end edges 16 of the sheet 11 to prevent the components 26 and 28 from pulling out of the ends of the sheet 11. The spacing between the components 26 and 28 across the ends 18 are the same on both ends so that the components 26 and 28 are in registration when the ends overlap. Since the sheet 11 is made out of an elastomeric material, the snap fastener components 26 and 28 are located so that the sheet 11 is stretched slightly when it is wrapped around the container CT and the components 26 and 28 snapped together to maintain the sheet 11 in place.

SECOND EMBODIMENT

Figure 4:
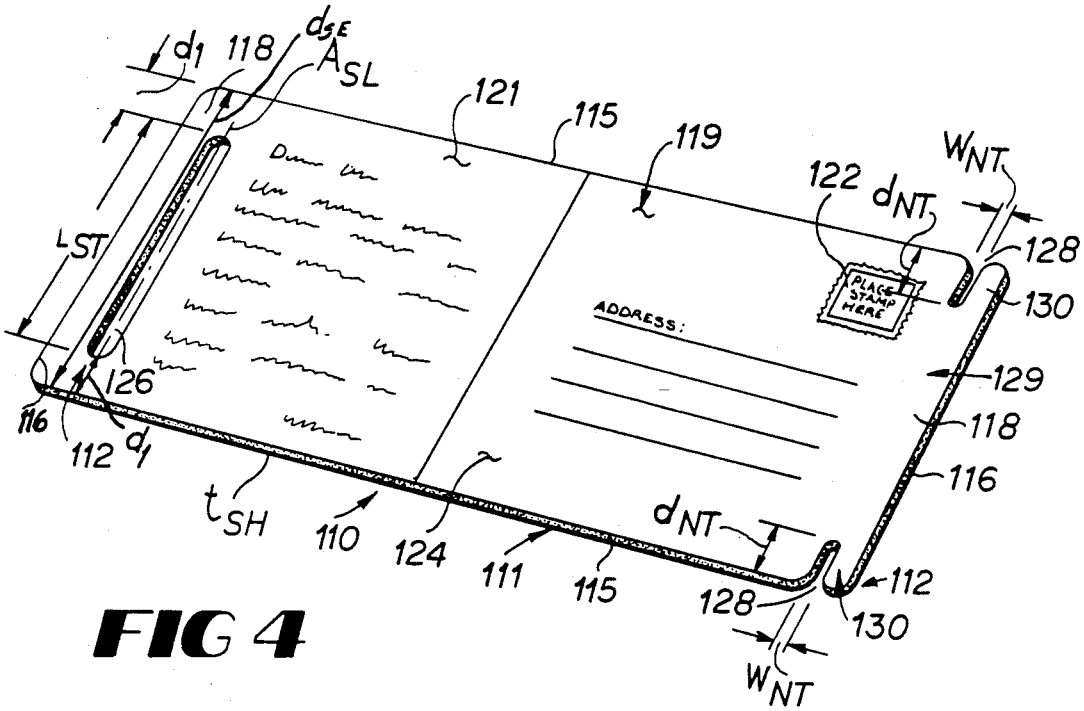
FIG. 4 is a perspective view of a second embodiment of the invention.

FIGS. 3 and 4 illustrate a second embodiment of the invention which has been designated by the reference number 110. The second embodiment of the invention is similar to the first embodiment in that it comprises a sheet 111 of flexible material which is held together by fastening means 112. The basic distance between the combination postcard/container insulator 110 and the insulator 10 is that the fastening means 112 is cut from the sheet 111 rather than being separately attached thereto.

Figure 5:
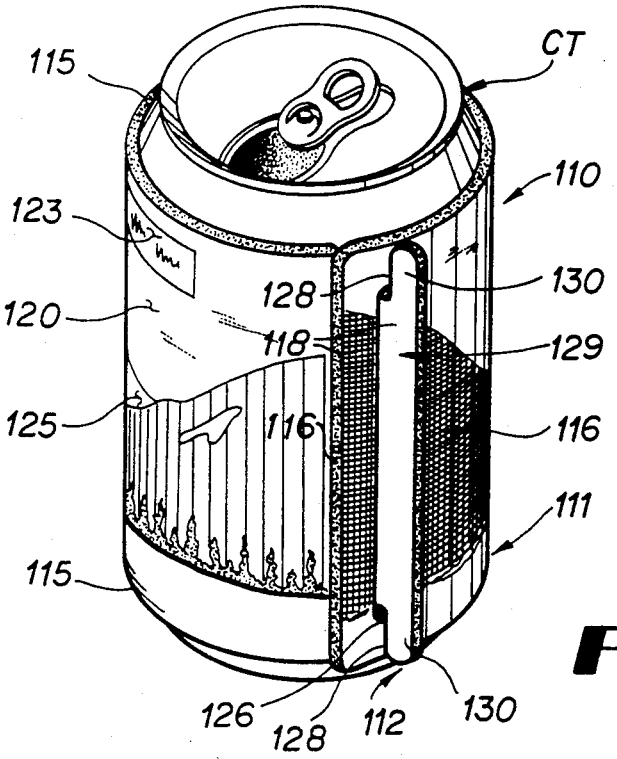
FIG. 5 is a perspective view showing the second embodiment of the invention installed on a container.

The sheet 111 defines side edges 115 thereon and end edges 116 thereon similar to the first embodiment of the invention. FIG. 4 illustrates the first side 119 of the sheet 111 while FIG. 5 illustrates the opposite second side 120 thereof. Like the first embodiment of the invention, the second embodiment defines a first message writing surface area 121, a second stamp mounting area 122 and a third address writing area 124 on the first side 119 while the printed surface area 25 is provided on the second opposite side 120.

The fastening means 112 comprises an elongate slot cut through said sheet 111 in one end 118 thereof with the longitudinal axis $A_{SL}$ of the slot 126 oriented parallel to the adjacent end edge 116 as best seen in FIG. 4. The slot 126 has a length $L_{ST}$ which is shorter than the height distance $d_{SE}$ between the side edges 115 so as to leave an end distance $d_1$ between each of the ends of the slot 126 and the adjacent side edge 115. The opposite end 118 of the sheet 111 has a pair of notches 128 cut therein with one of the notches located in the end 118 in opposite side edges 115 as best seen in FIG. 4. The notches 128 have a width $w_{NT}$ which is at least as great as the thickness $t_{SH}$. Each of the notches 128 has a depth $d_{NT}$ at least as great as the end distance $d_1$ so that a tab 129 with end projections 130 is formed on the end 118 where the notches 128 are located. The end projections 130 of the tab 129 can be deformed to pass through the slot 126 and released to return to the position seen in FIG. 5 so that the combination postcard/container insulator 110 will be held in position around the container CT.

I claim:

1. A combination postcard/container insulator adapted to fit a container with a container sidewall having a prescribed sidewall height and a prescribed peripheral length comprising:

a substantially rectilinear sheet of flexible material defining a pair of spaced apart side edges thereon spaced apart a prescribed first distance corresponding to said prescribed sidewall height of the container sidewall and a pair of spaced apart end edges thereon spaced apart a distance greater than the peripheral length of the container side wall so that those portions of said sheet adjacent said end edges can be overlapped when said sheet is wrapped around the container sidewall, said sheet being substantially flat when in its relaxed condition and wherein said sheet defines a first writing surface area thereon to record messages and a second postal stamp mounting surface area so that said sheet can be mailed; and, fastening means for maintaining said sheet wrapped around the sidewall of the container, said fastening means constructed and arranged to be acceptable for mailing when said sheet is in its substantially flat condition.

2. The combination postcard/container insulator of claim 1 wherein said sheet is made out of an insulating material so that said sheet serves to reduce the heat exchange with the container when said sheet is wrapped around the container.

3. The combination postcard/container insulator of claim 2 wherein said first and second surface areas are located on one side of said sheet; and, wherein said sheet defines a printing surface area on that side of said sheet opposite said first and second surface areas.

4. The combination postcard/container insulator of claim 3 wherein said fastening means includes:

first attachment means attached to said sheet adjacent one of said end edges; and, second attachment means attached to said sheet adjacent the other of said end edges, said first and second attachment means cooperating to hold one of said end edges overlapping the other of said end edges together when said sheet is wrapped around the container.

5. The combination postcard/container insulator of claim 4 wherein said first attachment means comprises a slot defined through said sheet adjacent one of said end edges; and, wherein said second attachment means comprises a tab cut from said sheet and sized larger than said slot, and a reduced size section connecting said tab to the rest of said sheet having a size similar to said slot so that said tab can be deformed and pushed through slot until said reduced size section is located in said slot and said tab released to prevent said tab from passing back through said slot to maintain said sheet wrapped around the container.

6. The combination postcard/container insulator of claim 4 wherein said first attachment means comprises at least one male snap member mounted in said sheet adjacent one of said end edges; and, wherein said second attachment means comprises at least one female snap member mounted in said sheet adjacent the other of said end edges so that said male and female snap members can be snapped together to maintain said sheet wrapped around the container.

7. The combination postcard/container insulator of claim 2 where the material of said sheet is a foamed acetate.

8. The combination postcard/container insulator of claim 7 wherein the material of said sheet is foamed ethyl vinyl acetate.

* * * * *